US005423552A

United States Patent [19]

English

[11] Patent Number: 5,423,552

[45] Date of Patent: Jun. 13, 1995

[54] TOKEN BOUNCING GAME

[76] Inventor: Patrick J. English, 3325 Summer Park Dr., #274, Sacramento, Calif. 95834

[21] Appl. No.: 183,656

[22] Filed: Jan. 19, 1994

[51] Int. Cl.[6] ..... A63F 7/06

[52] U.S. Cl. ..... 273/342; 273/400; 273/353

[58] Field of Search ..... 273/341, 342, 353, 400, 273/410

[56] References Cited

U.S. PATENT DOCUMENTS

| | | | |
|---|---|---|---|
| 1,114,523 | 10/1914 | Revell . | |
| 1,619,279 | 3/1927 | Wagner . | |
| 1,712,073 | 5/1929 | Fowler . | |
| 2,201,560 | 5/1940 | Nelson . | |
| 2,261,448 | 11/1941 | Petersen . | |
| 2,343,506 | 3/1944 | Hay . | |
| 2,611,615 | 9/1952 | Watson | 273/353 |
| 3,689,069 | 9/1972 | Rogers | 273/342 |
| 3,761,089 | 9/1973 | Slane | 273/342 |
| 4,030,760 | 6/1977 | Danowski . | |
| 4,052,064 | 10/1977 | Kennoy . | |
| 4,210,328 | 7/1980 | Meintzer | 273/342 |

FOREIGN PATENT DOCUMENTS

| | | | |
|---|---|---|---|
| 453603 | 12/1948 | Canada . | |
| 314215 | 6/1929 | United Kingdom | 273/342 |

*Primary Examiner*—Mark S. Graham
*Attorney, Agent, or Firm*—James M. Ritchey

[57] ABSTRACT

A basketball-like board game that is played by bouncing tokens off an obstacle impressed surface and into a receptacle having an angled backboard. Included is a token retrieval system to facilitate token collection and counting.

5 Claims, 4 Drawing Sheets

TOKEN BOUNCING GAME

BACKGROUND OF THE INVENTION

1. Field of the Invention

A game of skill is disclosed in which tokens a token is bounced into a receiving aperture. More specifically, within a given set of game rules, a player bounces a plurality of tokens off of a playing surface and into a cylindrical basket.

2. Description of the Background Art

Numerous games exist in which objects are directly or indirectly projected into receiving containers under varying sets of rules. In one aspect or another, many of these games mimic basketball.

Specifically, U.S. Pat. No. 1,114,523 relates a game apparatus comprising a plurality of cards that are sailed into a receptacle. A receptacle is fabricated from a sheet that is formed into a cylinder.

U.S. Pat. No. 1,619,279 discloses a basketball board game. The game board resembles a full basketball court. A flat circular disc is shot (in tiddlywinks fashion by a second hard disc or like item) by a player over the board toward circular scoring spaces at each end of the game board.

Another tiddlywinks-type board game is described in U.S. Pat. No. 1,712,073. At the end of a basketball-like game board are elevated baskets. Discs are projected by a tiddlywinks action toward the appropriate basket and scored accordingly.

A miniature basketball game is communicated in U.S. Pat. No. 2,201,560. This is another tiddlywinks-type game with a slight variation on the basket and court designs found in '073 immediately above.

A more sophisticated tiddlywinks-type basketball game is related in U.S. Pat. No. 2,261,448. A checkered rectangular playing board in bounded by baskets at each end. Complex scoring and rules are incorporated into the playing board.

U.S. Pat. No. 2,343,506 reveals a basketball board game, with end baskets, that is once again of the tiddlywinks-type style. Various rule are presented on the board.

A simulated basketball game is furnished in U.S. Pat. No. 2,611,615. The roll of three dice determines a shooting location on the board. Tiddlywinks action is utilized to propel a disc from the shooting location toward a basket.

Related in U.S. Pat. No. 4,030,760 is yet another tiddlywinks-type board game. Discs are snapped (tiddlywinks-like) from a selected shooting area into scoring depressions on an angled surface of the board. Smaller radiused depressions have a higher point value than larger radiused depressions.

Once again, a tiddlywinks-type basketball game is shown in U.S. Pat. No. 4,052,064. Slight improvement are included over the above cited similar games.

In Canadian Patent No. 453,603 the tiddlywinks theme is again presented. The board is divided into colored zones for shooting and scoring purposes.

Described in an airline catalog "Jetcetera" is a board game based on a parlor or bar game. Quarters or discs are thrown at the board by a played and bounced off a basketball court-like surface and, hopefully, into a basket. The elevated backboard of the basket is a traditional vertical form with the hoop secured to the backboard's front surface.

SUMMARY OF THE INVENTION

An object of the present invention is to provide a basketball-like board game.

Another object of the present invention is to disclosed a basketball-like board game that is played by bouncing tokens off a surface and into a scoring receptacle having an angled backboard.

A further object of the present invention is to supply a basketball-like board game that is played by bouncing tokens off an obstacle impressed surface and into a scoring receptacle having an angled backboard.

Still another object of the present invention is to present a basketball-like board game that is played by bouncing tokens off an obstacle impressed surface and into a scoring receptacle having an angled backboard and includes a token retrieval means.

Disclosed is a basketball-like board game utilized by a player. Comprising the game is a plurality of tokens (although substitute tokens such as coins are acceptable) and a generally rectangular game board. The game board has an upper surface with markings resembling a basketball half-court. The plurality of tokens are bounced, one at a time, by the player off the game board surface, thereby producing a trajectory for each of the bounced tokens.

Attached to the game board is a scoring receptacle means for receiving any of the bounced tokens that fit within the scoring receptacle means. Further, an angled backboard is mounted to the scoring receptacle means for deflecting each token trajectory that hits the angled backboard after the bounce.

Obstacle means are incorporated into said game board upper surface at a position that corresponds to the top of the shooting key. Should the player hit the obstacle means, usually raised nubs, with a thrown token, the obstacle means deflects the tokens' bounced trajectories and generally prevents the token from entering the scoring receptacle means. To facilitate playing the game, a token retrieval means is included.

Usually, a timing means is provided for tracking a period of time for the game. Also, the game generally includes scoring means for recording tokens that enter the scoring receptacle means during a game.

Other objects, advantages, and novel features of the present invention will become apparent from the detailed description that follows, when considered in conjunction with the associated drawings.

DESCRIPTION OF THE PREFERRED EMBODIMENT

Figure 1:
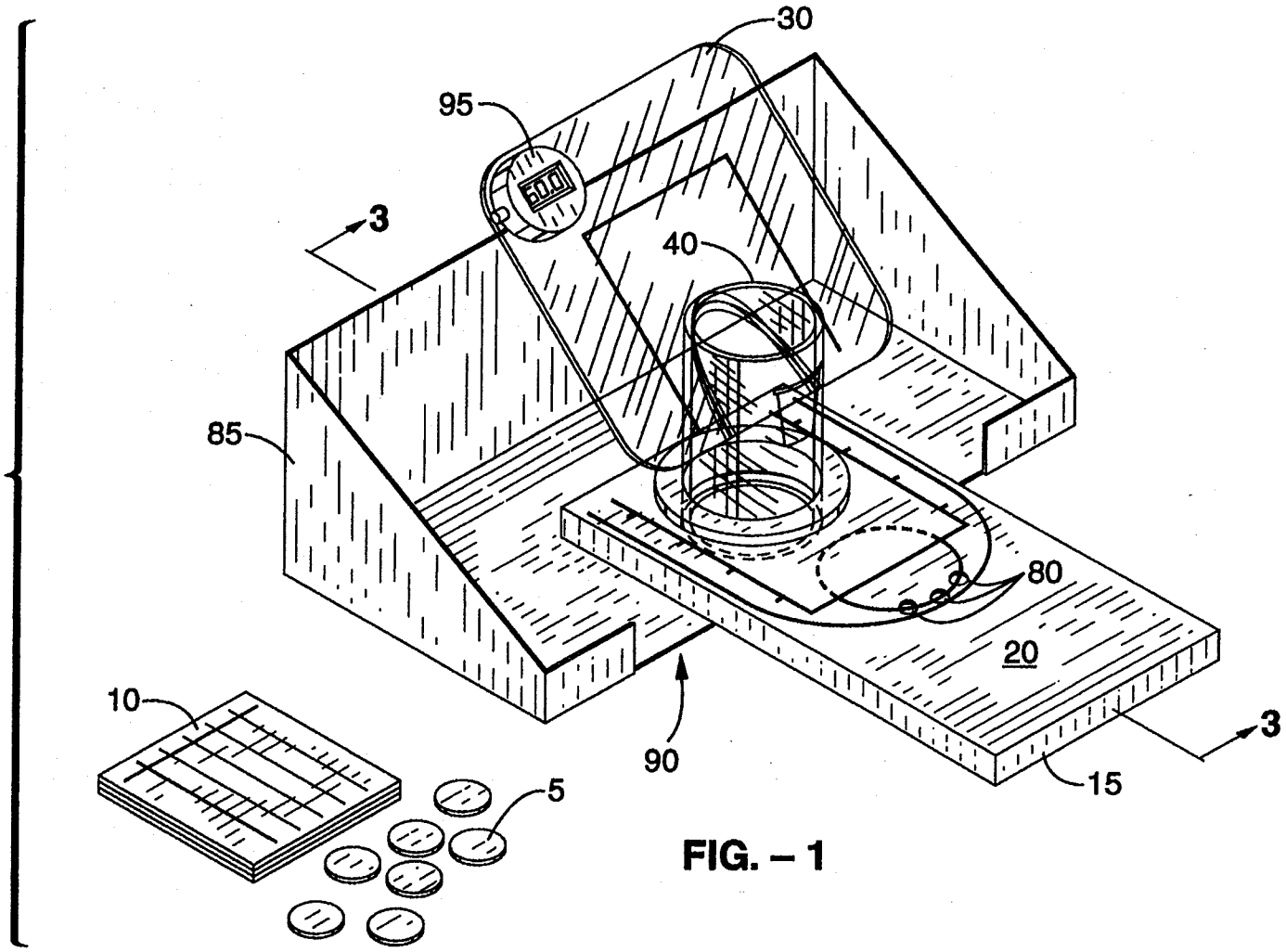
FIG. 1 is a perspective view of the subject apparatus.
Figure 2:
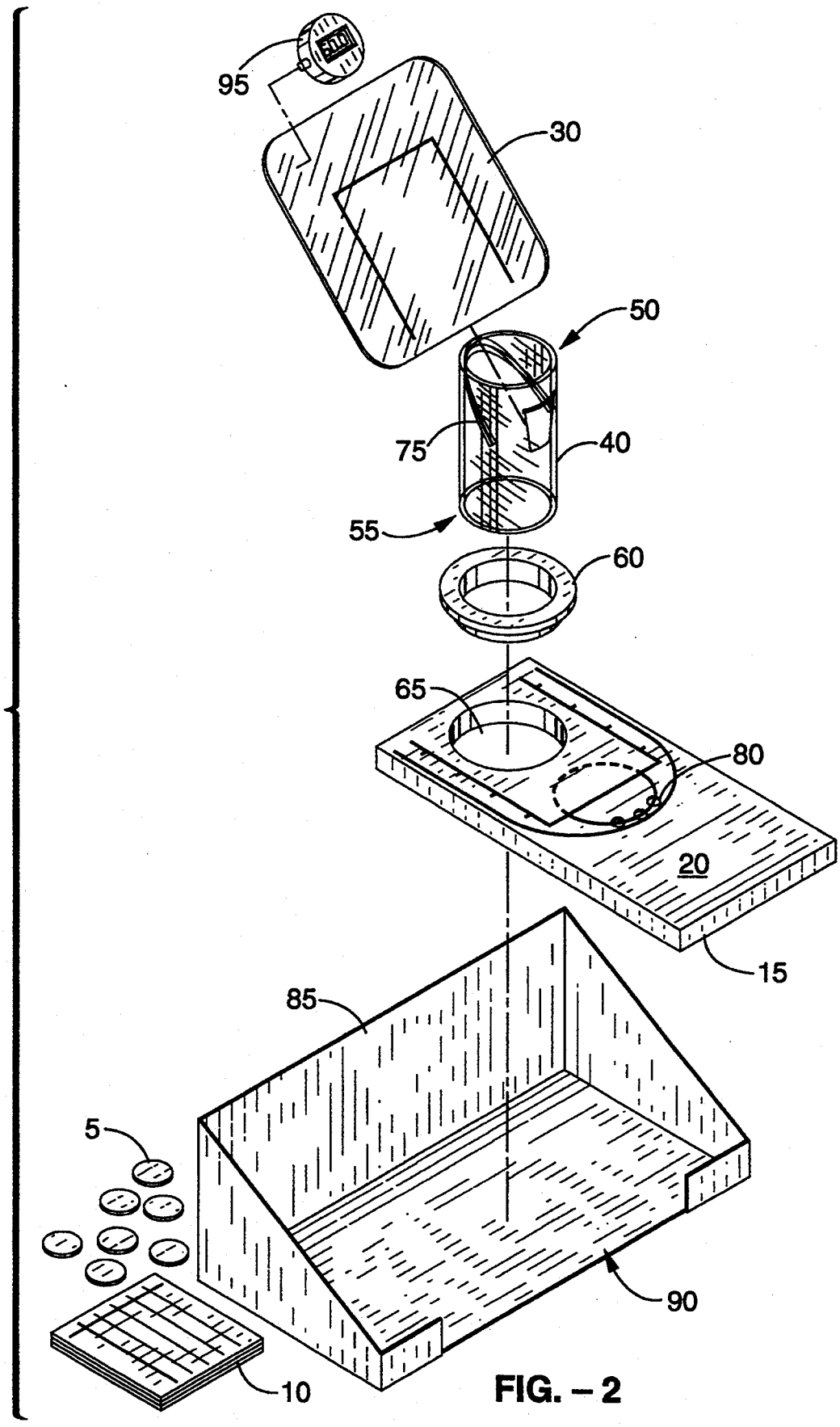
FIG. 2 is an exploded perspective view of the subject apparatus.

Referring now to FIGS. 1–4, there is shown a preferred embodiment of a basketball-like board game. Specifically, FIGS. 1 and 2 illustrate the subject invention, including tokens 5 and scoring means 10, in a perspective view and in an exploded perspective view. The subject board game invention comprises a generally rectangular game board 15 having an upper surface 20.

A player utilizes tokens, coins, or similar disc-like objects 5 as playing pieces that are bounced off the upper surface 20 of the board 15. Tokens 5 are usually metallic, however, other equivalent materials are suitable as long as an approximately similar bounce is obtained. A player throws a token 5 at the upper surface 20 and once the token 5 is bounced or deflected by the surface 20 each bounced token 5 has a bounced trajectory 25 as it leaves the surface 20 (see FIG. 4).

Generally, the board 15 is composed of wood, wood products, metal, synthetic or natural polymers, or the like. The upper surface 20 is rigid enough to deflect efficiently the incoming token 5. Often the board 15 is fabricated with a plastic laminate surface and a wood core.

Figure 3:
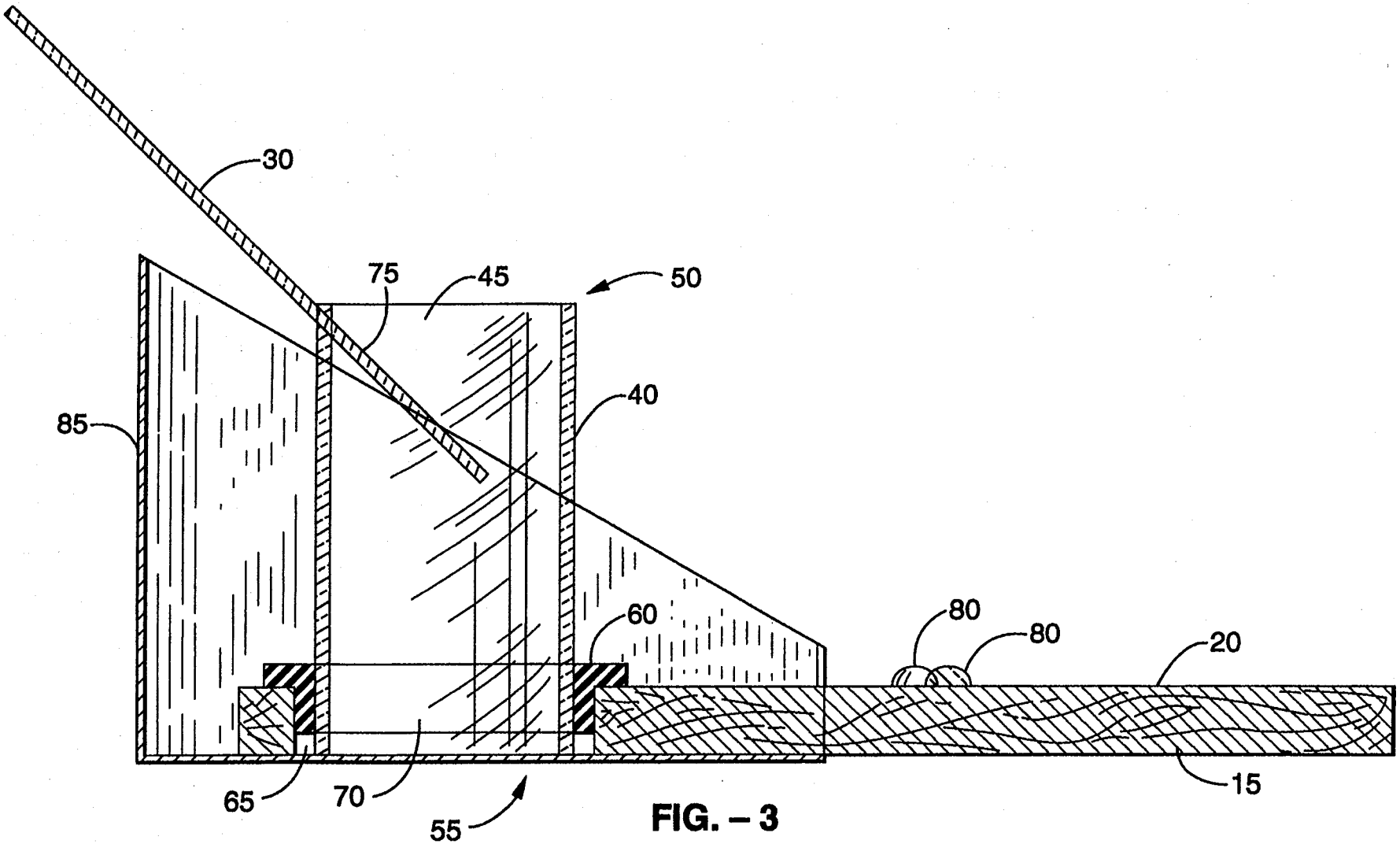
FIG. 3 is a sectional view of the subject apparatus taken along line 3—3 of FIG. 1.

A generalized image of a basketball half-court is presented on the upper surface 20 of the game board (see FIGS. 1–3). The image is applied to the surface by suitable standard means. Preferably, the image is resistant to being damaged or removed by repeated hits with the playing tokens 5.

Included in the subject invention is an angled backboard means 30 for deflecting each of the token trajectories 25 after each token 5 is bounced off the upper surface 20 and hits the angled backboard means 30. Each token 5 that hits the angled backboard means 30 proceeds in a new pathway 35. In basketball a vertical backboard is positioned behind a basket, but in the subject device the equivalent means is not vertical but angled. As seen in FIGS. 1–4, the backboard means is generally a planar member or backboard 30 and is often fabricated from a plastic material, but other equivalent substances are acceptable. Equivalent substances include materials that can deflect a bounced incoming token 5 such as woods, metals, polymers, and the like.

Serving the equivalent role of the basket or hoop in basketball is the scoring receptacle means 40 in the subject board game. The scoring receptacle means 40 is for receiving any of the bounced tokens that happen to fit within an upper opening 45 in the receptacle means 40. Commonly, the receptacle means 40 comprises a cylindrical tube 40 having first 50 and second 55 ends. The cylinder's second end 55 is generally affixed to the game board 15 directly or indirectly via the upper surface 20.

Often, as seen in FIGS. 1–4, a cylinder gasket 60 is employed to secure the cylinder 40 into an aperture 65 in the board 15. The gasket 60 is usually formed from a resilient material such a soft rubber or the equivalent that permits a player to rapidly and easily assembly the subject apparatus. Further, as can be readily noted, the subject apparatus is easily separated into individual components for packaging and storage.

Usually, the scoring receptacle means or cylindrical tube 40 serves as a mounting means for securing the angled backboard means to the cylinder 40 proximate the first end 50. One preferred mounting means comprises an angled cut, slit or groove 75 proximate the tube's first end 50. The angled groove 75 is sized to accept snugly the backboard 30, thereby producing the angled nature of the angled backboard means 30.

Figure 4:
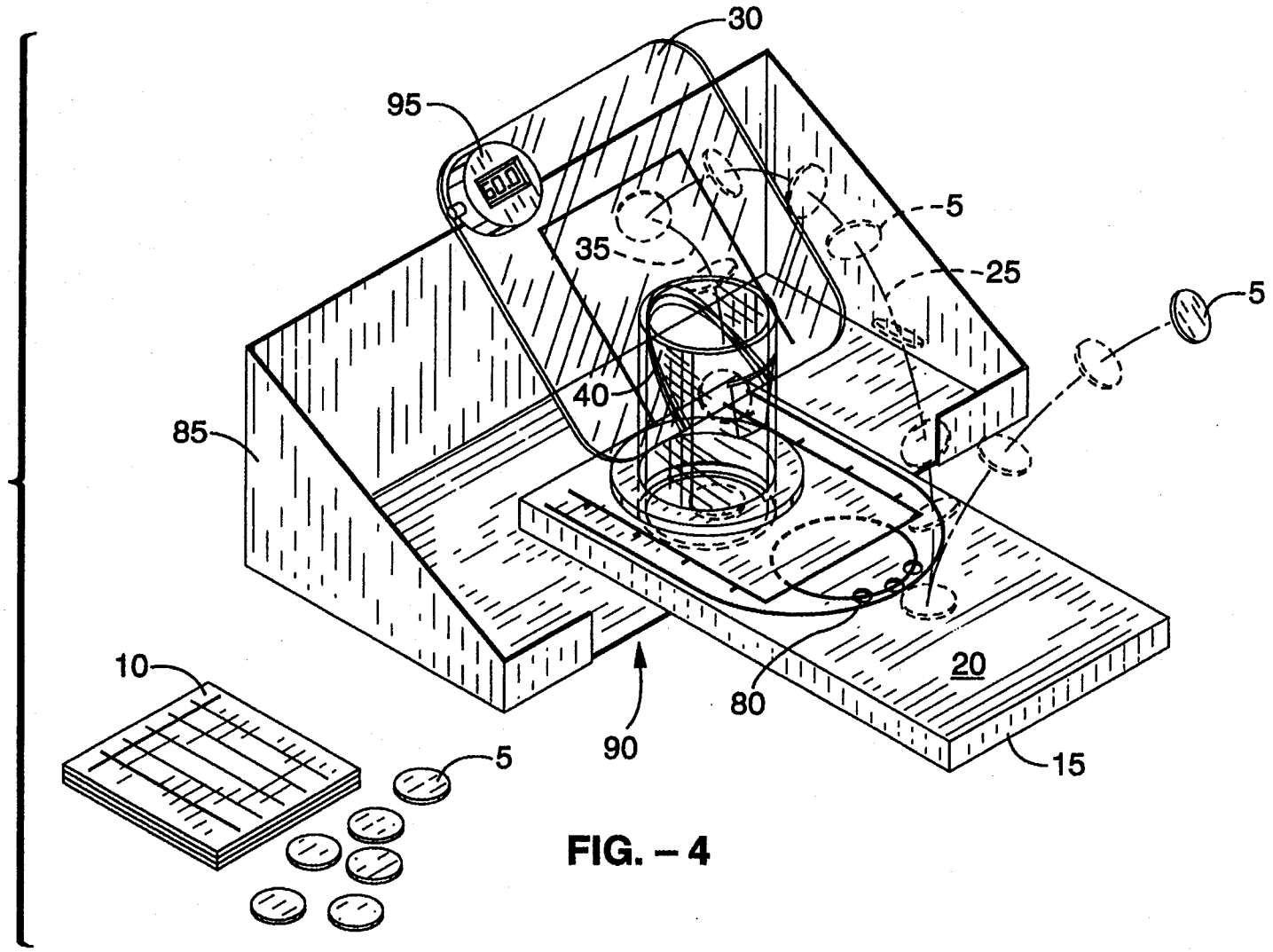
FIG. 4 is a perspective view of a token being bounced from a playing board surface, off a backboard, and into a scoring receptacle.

On the upper surface 20 of the game board 15 is an obstacle means. Usually, the obstacle means comprises a raised or elevated nub or nubs 80. As seen in FIGS. 1, 2, and 4, preferably, the number of nubs 80 that project above the upper surface 20 is three, however, more or less are contemplated to be within the realm of this disclosure. The nubs 80 are positioned approximately along what in basketball is known as the "three-point line" at the top of the shooting key that is depicted on the upper surface 20. Should a thrown token 5 strike or hit a nub 80, the token 5 is deflected, usually in an unpredictable pathway, thereby not generally entering the scoring receptacle 40. The nubs 80 are fabricated from resilient materials such as plastics, rubbers, other synthetic or natural polymers, and the like or even woods or metals.

One great advantage of the subject invention over existing basketball-like board games is the inclusion of a token retrieval means. The token retrieval means comprises the cylinder 40 mounted by its second end 55 penetrating the game board 15 through the aperture 65 to produce the scoring tunnel 70. The scoring tunnel 70 holds the tokens 5 that have entered the cylinder 40 for a score. Since the tunnel 70 penetrates the board 15, a player only needs to lift the board 15 and any of the scoring tokens 5 within the cylinder 40 will exit the tunnel 70 beneath the game board 15.

Preferably, further comprising the token retrieval means is a housing 85 for collecting tokens 5 that fail to enter or miss the scoring cylinder tube 40. The housing 85 is often the container in which the game is packaged and supplied or sold to the player. Generally, the housing 85 comprises a container with a bottom panel, two side panels, a back panel, and a front panel having a game board receiving channel 90 into which the game board 15 is positioned or sits. After a game is completed, the game board 15 is lifted and the scoring tokens 5 exit via the scoring tunnel 70 while the missed shots mostly are found within the housing 85. The player merely slides or pours the missed tokens 5 out of the housing 85 via the channel 90. Once the tokens 5 are collected the board 15 and other attached components are repositioned within the housing 85 with the board 15 extending out through the channel 90.

Frequently, the game as supplied to a player comprises (in addition to the board 15, scoring receptacle means 40, angled backboard 30, obstacle means 80, and token retrieval means 70 and 85), a set of tokens 5, a timing means 95 for tracking a period of time necessary to play the game, and scoring means 10 for recording tokens that entered the scoring receptacle means 40.

The tokens 5 can be supplied in any suitable number and in various sizes. Usually, the tokens 5 are approximately the size of a U.S. quarter. Preferably, metal is utilized to fabricate the tokens 5, but other materials are possible as long as a suitable bounce trajectory is generated.

Timing means 95 usually comprises a clock or equivalent means. As shown in FIGS. 1, 2, and 4, the timing means 95 is a small digital watch mounted on the upper corner of the backboard 30. Other mounting locations are acceptable.

Scoring means 10 are provided for keeping track of a player's (or players') score. Usually, the scoring means 10 comprises (as seen in the figures) a score pad of paper with suitable areas denoted for appropriate indicia such as total tokens, scored tokens, missed tokens, time taken, and the like.

By way of example only and not by way of presenting rigid rules unalterable procedures, playing the subject game is depicted in FIG. 4. Ordinarily, each player sits of stand in front of the assembled game. The clock is set to a time period such as 60 seconds. Perhaps seven to eleven tokens are held in the non-shooting hand and one in the shooting hand. The clock is started and the played begins to bounce the tokens, one-at-a-time, off the game board and hopefully into the scoring cylinder either directly or indirectly off the angled backboard. Either the time of play is fixed and the number of scoring tokens counted or the time needed to score a fixed number of tokens is recorded.

Preferably, the token is thrown or shot into the upper board surface by holding the token between the index finger and thumb. The player's hand is generally six to seven inches above the board when the token is released. A more reliable bounce from the board's surface appears to result when the token strikes the surface on or nearly on its flat surface and not on its edge, although either way may generate a scoring shot.

The invention has now been explained with reference to specific embodiments. Other embodiments will be suggested to those of ordinary skill in the appropriate art upon review of the present specification. Although the foregoing invention has been described in some detail by way of illustration and example for purposes of clarity of understanding, it will be obvious that certain changes and modifications may be practiced within the scope of the appended claims.

What is claimed is:

1. A board flame utilized by a player, comprising:

a) a generally non-covered and flat game board having an upper surface upon which a plurality of disc-like tokens are bounced by the player thereby producing a traiectory for each of said bounced tokens;

b) scoring receptacle means affixed to said game board via said upper surface adapted for receiving any of said bounced tokens that fit within said scoring receptacle means, wherein said scoring receptacle means comprises a cylindrical tube having first and second ends with said second end affixed to said game board upper surface, c) an angled backboard means mounted to said scoring receptacle means adapted for deflecting each said token trajectory for each said token that hits said angled backboard means after said bounce.

2. A board flame utilized by a player, comprising:

a) a generally non-covered and flat game board having an upper surface upon which a plurality of disc-like tokens are bounced by the player thereby producing a traiectory for each of said bounced tokens;

b) scoring receptacle means affixed to said flame board via said upper surface adapted for receiving any of said bounced tokens that fit within said scoring receptacle means, wherein said scoring receptacle means comprises a cylindrical tube having first and second ends with said second end affixed to said game board upper surface;

c) an angled backboard means mounted to said scoring receptacle means for deflecting each said token traiectory for each said token that hits said angled backboard means after said bounce; and d) a token retrieval means wherein said token retrieval means comprises said tube second end penetrating said game board through an aperture formed in said game board to generate a scoring tunnel whereby when said board is lifted any of said tokens that bounced into said tube exit said tunnel beneath said game board, wherein said token retrieval means further comprises a housing for collecting a token that misses said tube, wherein said housing comprises a container with a bottom panel, two side panels, a back panel, and a front panel having a game board receiving channel.

3. A basketball-like board flame utilized by a player, comprising:

a) a generally non-covered, flat, and rectangular game board having an upper surface with markings resembling a basketball half-court upon which a plurality of disc-like tokens are bounced by the player thereby adapted for producing a trajectory for each of said bounced tokens;

b) scoring receptacle means affixed to said flame board via said upper surface adapted for receiving any of said bounced tokens, wherein said scoring receptacle means comprises a cylindrical tube having first and second ends with said second end affixed to said game board upper surface; and c) an angled backboard mounted to said scoring receptacle means adapted for deflecting each said token traiectory for each said token that hits said angled backboard after said bounce, wherein an angled groove formed in said tube proximate said first end servers as a mounting means for securing said angled backboard.

4. A basketball-like board game utilized by a player, comprising:

a) a generally non-covered, flat, and rectangular game board having an upper surface with markings resembling a basketball half-court upon which a plurality of disc-like tokens are bounced by the player thereby producing a traiectory for each of said bounced tokens;

b) scoring receptacle means affixed to said game board via said upper surface adapted for receiving any of said bounced tokens, wherein said scoring receptacle means comprises a cylindrical tube having first and second ends with said second end affixed to said game board upper surface;

c) an angled backboard mounted to said scoring receptacle means adapted for deflecting each said token traiectory for each said token that hits said angled backboard after said bounce; and d) a token retrieval means wherein said token retrieval means comprises said tube second end penetrating said game board through an aperture formed in said game board to fienerate a scoring tunnel whereby when said board is lifted any of said tokens that bounced into said tube exit said tunnel beneath said game board, wherein said token retrieval means further comprises a housing for collecting said token that misses said tube wherein said housing comprises a container with a bottom panel, two side panels, a back panel, and a front panel having a game board receiving channel.

5. A basketball-like board game utilized by a player, comprising:

a) a plurality of disc-like tokens;

b) a generally non-covered, flat, and rectangular game board having an upper surface with markings resembling a basketball half-court upon which said plurality of tokens are bounced by the player thereby producing a trajectory for each of said bounced tokens;

c) scoring receptacle means affixed to said game board via said upper surface for receiving any of said bounced tokens, wherein said scoring receptacle means comprises a cylindrical tube;

d) an angled backboard mounted to said scoring receptacle means in an angled groove formed in said tube for deflecting each said token trajectory for each said token that hits said angled backboard after said bounce;

e) obstacle means incorporated into said game board upper surface whereby said obstacle means deflects said tokens' bounced trajectories;

f) token retrieval means;

g) timing means for tracking a period of time; and h ) scoring means for recording tokens that enter said scoring receptacle means.

* * * * *